US005454566A

United States Patent [19]

Koenig

[11] Patent Number: 5,454,566

[45] Date of Patent: Oct. 3, 1995

[54] SKELLY GAME

[76] Inventor: Scott Koenig, 29 N. Bromleigh Rd., Stewart Manor, N.Y. 11530

[21] Appl. No.: 238,492

[22] Filed: May 5, 1994

[51] Int. Cl.[6] ..... A63B 67/06

[52] U.S. Cl. ..... 273/126 R; 273/127 R; 273/57.1; 273/108

[58] Field of Search ..... 273/57, 1, 85 R, 273/353, 342, 347, 341, 127 R, 317, 108, 126 R, 128 R, 348

[56] References Cited

U.S. PATENT DOCUMENTS 1,292,011 1/1919 Monroe ..... 273/424

3,008,718 11/1961 Berliner ..... 273/57.1

FOREIGN PATENT DOCUMENTS 1501915 10/1967 France ..... 273/286

*Primary Examiner*—Mark S. Graham
*Attorney, Agent, or Firm*—Michael I. Kroll

[57] ABSTRACT

An improved Skelly game is provided which consists of a game board having a court with a plurality of numbered bases randomly placed thereon and a plurality of pucks with each puck used by each player. The first player to propel their respective puck through each of the numbered bases in sequential order and then propel the puck through each of the numbered bases in a reverse sequential order wins the game.

1 Claim, 2 Drawing Sheets

SKELLY GAME

BACKGROUND OF THE INVENTION

Field of the Invention

The instant invention relates generally to street games and more specifically it relates to an improved Skelly game.

This invention relates generally to competitive games played upon gameboards.

The present invention relates generally to games of skill involving the pitching or tossing of a marker(s) at a target, and more specifically to such a game providing for scoring in a manner simulating bowling.

Description of the Prior Art

It is difficult to pinpoint the birth of Skelly, though the game relies heavily on a lazy man's approach to Hopscotch. Basically, bottle caps instead of feet hop through a series of numbered boxes chalked or painted on the street. Perhaps the word Skelly comes from "skeeter," a type of bug that whizzes across lakes and swamps as do the bottle caps on the pavement.

The game is played in most urban areas such as New Bedford, Boston, Atlanta, San Diego, Portland and Tampa, to name a few. Without dispute, however, the Skelly capitol of the world is Brooklyn, N.Y. If a player is from Brooklyn, for him, that is equivalent to the whole world.

The only prerequisites for the game are asphalt streets and bottle caps. After cobblestones replaced the dirt road in the early 19th century, it was only a few years before the first asphalt road was laid in this country in the spring of 1874 on I Street N.W., in Washington, D.C.

The other key element in the game, the bottle cap (Crown Cork and Seal) was born 17 years later. The proud father, William Painter, a machine shop foreman from Maryland, patented his brain child. He successfully succeeded in capping the 1,500 others who had made attempts at such an invention dating as far back as Ancient Egypt. On the 23rd birthday of his "crowns" (or caps), Coca-Cola introduced the design into its bottling plant, and the crown cap was well on its way to stardom. (It was a fruitful venture; the family of caps has grown to 330 million gross annually.)

The Skelly player need not fear for shortages, there are miles of asphalt and plenty of caps around, through in some concerned areas, checkers have been substituted for bottle caps.

Though a specific date cannot be affixed to the first Skelly game, obviously it has to follow the invention of the cap and the application of asphalt to roads, since skimming caps across cobblestone or dirt roads was highly unlikely. The intersection of these two innovations puts the date for the beginning of Skelly somewhere at the turn of the 20th century.

Numerous street games, such as Hopscotch have been provided in prior art. Hopscotch is a children's game in which players toss a small object into numbered spaces of a pattern of rectangles outlined on the ground and then hop or Jump through the spaces to retrieve the objects.

Numerous innovations for a Skelly game have been provided in the prior art that are described as follows. Even though these innovations may be suitable for the specific individual purposes to which they address, they differ from the present invention as hereinafter contrasted.

U.S. Pat. No. 2,344,737 issued to Ralph M. Schlesinger on Mar. 21, 1944 discloses a Game Board having several embodiments. Corner pockets or side recesses are included in each of the embodiments; playing pieces are tossed and collect within the recesses of the playing board(s). No rules of play or method of scoring are disclosed.

U.S. Pat. No. 3,306,615 issued to Oscar F. Tack on Feb. 28, 1967 discloses a Toss Game Simulating Bowling. Rather than a single token or coin being tossed per each play, ten markers are tossed simultaneously at a target representing bowling pins. No numbers are marked on the board to be used to determine the score of a play; the markers landing and remaining within a specified area are counted to determine the score for that play. The scoring is like that used for bowling.

U.S. Pat. No. 3,876,070 issued to Bela Nagy on Apr. 8, 1975 discloses Tiered Target, Disc-Shaped Projectiles And Carrying Case. Markers or discs are tossed toward the target, with the object being to have the markers alight and rest upon the uppermost tier to provide the greatest score. No other cumulative means of keeping score is disclosed, nor other details such as the number of players and/or playing pieces, number of tosses per play, etc.

U.S. Pat. No. 4,126,309 issued to Alan A. Hicks et al. on Nov. 21, 1978 discloses a Rotatable Target Game Device in which the multiple targets are disposed in a moving platform. The projectiles are dropped through rings toward the rotating targets.

U.S. Pat. No. 4,239,221 issued to Albert N. Griffin on Dec. 16, 1980 discloses a Game Device including a horizontal target with concentric rings, into which dice are rolled. Scoring may simulate that used for several different games, but does not lend itself to ready adaptation to bowling scoring due to the limited numbers.

U.S. Pat. No. 4,288,076 issued to Ralph Oyague et al. on Sep. 8, 1981 discloses a Foldable Gameboard And Disc Playing Piece Apparatus. Each player uses a different marker, and the markers are propelled by a mechanical device toward numbered areas on a board; the markers are projected from a starting point on the board. No specific scoring system is disclosed.

Finally, U.S. Pat. No. 4,726,592 issued to Bayliss O. Callaham on Feb. 23, 1988 discloses an Amusement Device And Method For Use. The device comprises a cruciform pattern with a central cup. The object is to bounce a ball from one of the legs, thence to rebound into the cup. No scoring system is disclosed, other than noting that a record is kept of successful plays. Amusement games of various types are utilized throughout the prior art, with the amusement games having various elements of chance and path structure to direct tokens therealong in a manner as indicated in the U.S. Pat. Nos. 4,878,675; 4,955,617; 4,927,145; 4,890,843; and 4,913,440.

Accordingly, it may be appreciated that there continues to be a need for a new and improved amusement game as set forth by the instant invention which addresses both the problems of ease of use as well as effectiveness in construction and in this respect, the present invention substantially fulfills this need.

None of the above noted patents, taken either singly or in combination, are seen to disclose the specific arrangement of concepts disclosed by the present invention.

U.S. Pat. No. 4,288,076

Foldable gameboard and disc playing piece apparatus

Ralph Oyague and George Spector

A game device that includes a foldable, large gameboard with playing spaces marked out thereupon, a set of various different colored playing pieces for movement on the gameboard, and several shooters for propelling the playing pieces toward the gameboard spaces.

U.S. Pat. No. 5,282,635

Marker toss game

Randolph M. Hopkins

A game involving the tossing or pitching of a marker(s) onto a board having numbers marked thereon and representing possible pin counts in the game of bowling, is scored using the scoring system developed for bowling. Areas of equal size are marked with the numbers one through eight, with a central cup having a value of ten points; a concentric area around the cup has a value of nine. Players toss markers, such as a twenty five cent coin, toward the board and attempt to bounce the marker off of the board surface and into the raised cup to score a strike. The cup is removable from the underlying retainer portion to facilitate the removal of any markers or coins which land therein. Various possible marker positions are provided for in the scoring. The board and central cup may be constructed to any scale deemed suitable or desired.

U.S. Pat. No. 5,188,364

Amusement game

Carmine L. Falzarano

An amusement game is formed with a serpentine path formed of various segments. The segments include various hazards, wherein locomotion tool structure is arranged to direct token discs along various top surfaces of the segments, whereupon displacement of the predetermined top surfaces of the discs relative to the top surfaces effects repositioning of the discs to starting the path anew.

Numerous innovations for game have been provided in the prior art that are adapted to be used. Even though these innovations may be suitable for the specific individual purposes to which they address, they would not be suitable for the purposes of the present invention as heretofore described. The above described games differ from the present invention for the following reasons:

a) they do not contain bumper tubes which function to keep the bard flat, b) a different strategy is employed, c) One can use the puck to ricochet off the bumper tubes to reach next box, d) one can also ricochet an opposing players puck into "No Mans Land" where he or she must start the game all over again, e) bumper tubes keep the puck from escaping off the game board, f) there exists nine (9) boxes arranged in a three (3) boxes on each side in exact dimension from each other instead of the prior art described thirteen (13) boxes, g) less congested game playing area, h) game board exhibits an "Out Of Bounds Area", and i) improved strategy and confinement.

SUMMARY OF THE INVENTION

On the other hand, various informal games have been developed which test physical skills off one sort or another, but do not require extensive facilities or equipment; an example is the old game of tossing or pitching bottle caps or coins to the base of a wall. While there is undeniably some skill involved in such a game, the lack of any other rules or goals generally result in the players losing interest in short order.

The need arises for a game of skill combining many of the more challenging aspects of the game of bowling and using the scoring system therefor, which may be played in a limited space or area and using limited equipment. The game should be playable by any practicable number of players from one upwards, and must be playable by players of various skill levels. The scoring system should provide for the quantifying of the skill level of the player(s).

By the present invention, an improved skelly game is disclosed.

Accordingly, one of the objects of the present invention is to provide an improved skelly game in which one or more players toss one or more markers toward designated target areas marked on a board.

A primary object of the present invention is to provide an improved Skelly game that will overcome the shortcomings of the prior art devices.

Another object is to provide an improved Skelly game in which the first player to propel a puck from a starting line through each of a plurality of numbered bases on a game board in sequential order, until the center base is reached and then propel the puck in reverse order until the starting line is reached wins the game.

An additional object is to provide an improved Skelly game in which the game board is made out of a square flexible sheet with removable bumper tubes on its edges, so that it can be rolled up for storage when not in use and it can be extended flat when the game is played.

A further object is to provide an improved Skelly game that is simple and easy to use.

A still further object is to provide an improved Skelly game that is economical in cost to manufacture.

Further objects of the invention will appear as the description proceeds.

A principal object of the present invention is to provide a novel game in which playing pieces are propelled by hand shooting for movement upon a relatively small gameboard.

Another object is to provide an improved skelly game that will appeal to both children and adults.

Another of the objects of the present invention is to provide an apparatus for such an improved skelly game.

Yet another of the objects of the present invention is to provide an improved skelly game including a rectangular board having a plurality of numerically marked areas radially disposed from the center with the numbers representing scoring values, and numerically marked areas extending radially from the center of the board.

Another object of the present invention is to provide such a game board in which adjacent sets of numbers on the board have the same total value as adjacent sets of two numbers on each of the other sides.

Still another of the objects of the present invention is to provide such a game board which includes an area representing a highest value or score.

An additional object of the present invention is to provide such a game board in which the game board is removable, and which further includes means for retaining the central box in position during the course of play and peripheral retaining means to prevent markers from leaving the board.

A further object of the present invention is to provide a marker toss game in which the markers may be bottle caps.

And another object of the present invention is to provide a game in which the numbers and the board may be used in scoring in the manner of scoring in the game of bowling.

With these and other objects in view which will more readily appear as the nature of the invention is better understood, the invention consists in the novel combination and arrangement of parts hereinafter more fully described, illustrated and claimed with reference being made to the attached drawings.

In view of the foregoing disadvantages inherent in the known types of skelly games now present in the prior art, the present invention provides an improved skelly game wherein the same is arranged to direct various discs along a path directing discs to begin the path anew upon inadvertent displacement of a token disc relative to predetermined top surfaces of the path. As such, the general purpose of the present invention, which will be described subsequently in greater detail, is to provide a new and improved skelly game which has all the advantages of the prior art amusement games and none of the disadvantages.

The present invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved skelly game which has all the advantages of the prior art skelly games and none of the disadvantages.

It is another object of the present invention to provide a new and improved skelly game which may be easily and efficiently manufactured and marketed.

It is a further object of the present invention to provide a new and improved skelly game which is of a durable and reliable construction.

An even further object of the present invention is to provide a new and improved skelly game which is susceptible of a low cost of manufacture with regard to both materials and labor, and which accordingly is then susceptible of low prices of sale to the consuming public, thereby making such skelly game economically available to the buying public.

Still yet another object of the present invention is to provide a new and improved skelly game which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

Figure 1:
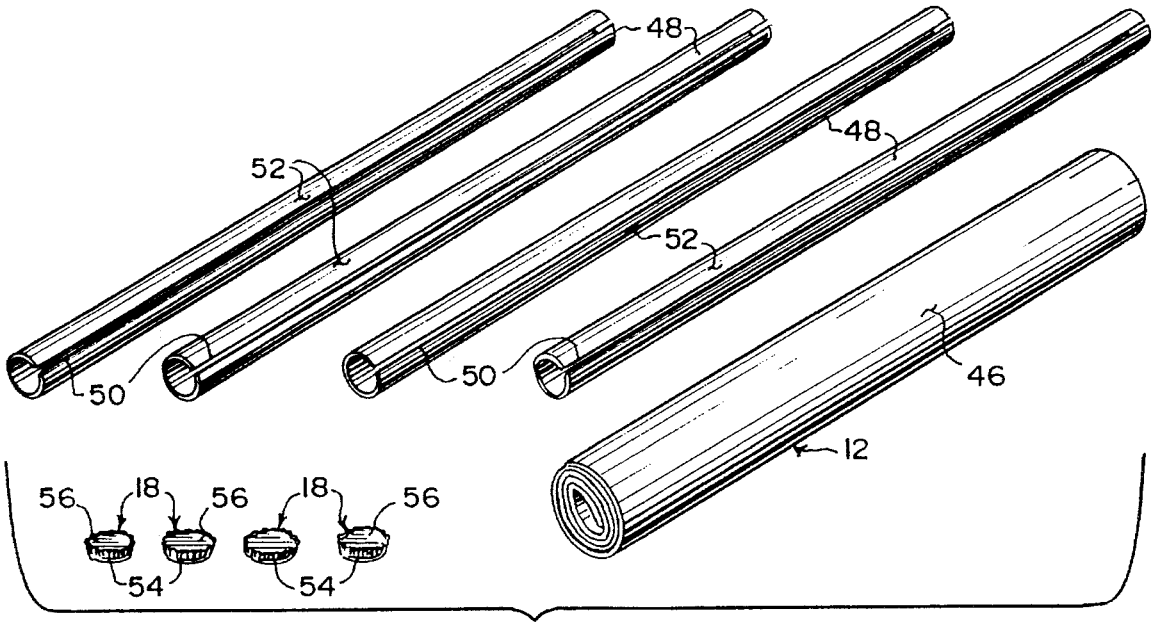
FIG. 1 is a perspective view of the various components of the instant invention.
Figure 2:
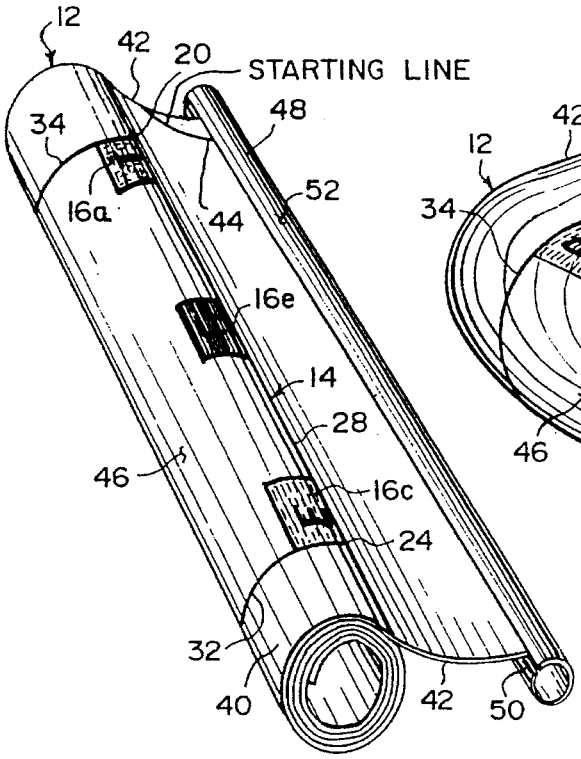
FIG. 2 is a perspective view showing one of the bumper tubes attached to one edge of the rolled up flexible sheet.
Figure 3:
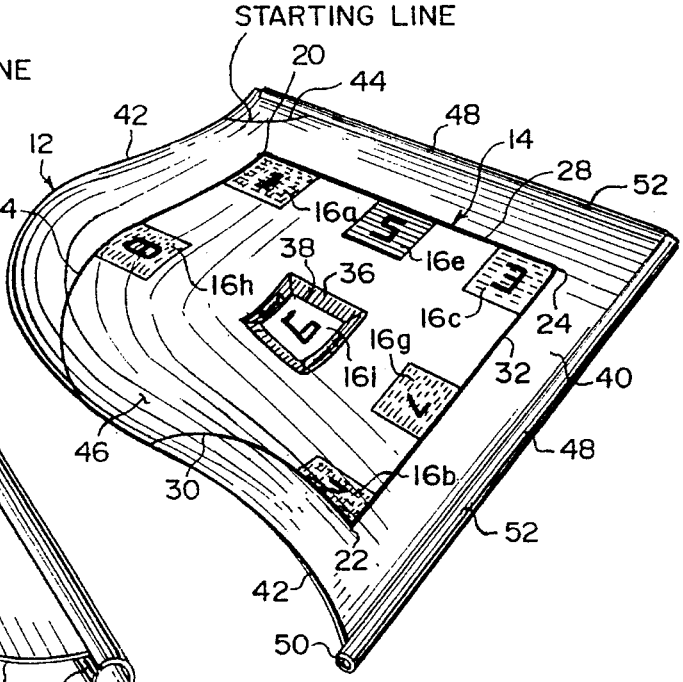
FIG. 3 is a perspective view showing two bumper tubes attached to two edges of the flexible sheet being rolled out flat.

10—improved Skelly game
12—game board
14—court on 12
16*a*—first base
16*b*—second base
16*c*—third base
16*d*—fourth base
16*e*—fifth base
16*f*—sixth base
16*g*—seventh base
16*h*—eighth base 16*i*—ninth base
18—puck
20—first corner of 14
22—second corner of 14
24—third corner of 14
26—fourth corner of 14
28—first side of 14
30—second side of 14
32—third side of 14
34—fourth side of 14
36—no man's land area
38—perimeter of 16*i*
40—out of bounds area
42—edge of 12
44—diagonal starting line on 12
46—flexible sheet for 12
48—bumper tube
50—longitudinal slot in 48
52—durable strong plastic material for 48

DETAILED DESCRIPTION OF THE PREFERRED EMBODIMENT

Turning now descriptively to the drawings, in which similar reference characters denote similar elements throughout the several views, the Figures illustrate an improved Skelly game 10 which consists of a game board 12 having a court 14 with a plurality of numbered bases 16*a* to 16*i*, randomly placed thereon and a plurality of pucks 18, with each puck 18 used by each player. The first player to propel their respective puck 18 through each of the numbered bases 16*a* to 16*i* in sequential order and then propel the puck 16 through each of the numbered bases 16*i* to 16*a* in a reverse sequential order, wins the game.

The court 14 is square shaped, each base 16*a* to 16*i* is square shaped and the bases 16*a* to 16*i* are nine in number. The first base 16*a* is located in a first corner 20 of the court 14. The second base 16*b* is located in a second corner 22 of the court 14 diagonally opposite from the first base 16*a*. The third base 16*c* is located in a third corner 24 of the court 14 opposite from the first base 16*a*. The fourth base 16*d* is located in a fourth corner 26 of the court 14 diagonally opposite from the third base 16*c*.

The fifth base 16*e* is located on a first side 28 of the court 14 between the first base 16a and the third base 16*c*. The sixth base 16*f* is located on a second side 30 of the court 14 between the second base 16*b* and the fourth base 16*d* opposite from the fifth base 16*e*. The seventh base 16*g* is located on a third side 32 of the court 14 between the second base 16*b* and the third base 16*c*. The eighth base 16*h* is located on a fourth side 34 of the court 14, between the first base 16*a* and the fourth base 16*d* opposite from the seventh base 16*g*. The ninth base 16*i* is located in the center of the court 14.

The court 14 further includes a no man's land area 36 located about a perimeter 38 of the ninth base 16*i*. The no man's land area 36 is square shaped and the game board 12 is also square shaped. The court 14 is smaller in size than the total size of the game board 12, thereby defining an out of bounds area 40 between the perimeter of the court 14 and four edges 42 of the game board 12.

The game board 12 further contains a diagonal starting line 44 located in the out of bounds area 40 near the first corner 20 of the court 14, adjacent the first base 16*a*. All of the pucks 18 are put at the starting line 44 at the beginning of the game to be propelled therefrom.

The game board 12 is fabricated out of a flexible sheet 46, such as paper or thin plastic, so that the game board 12 can be rolled up for storage when not in use, as shown in FIG. 1.

Figure 4:
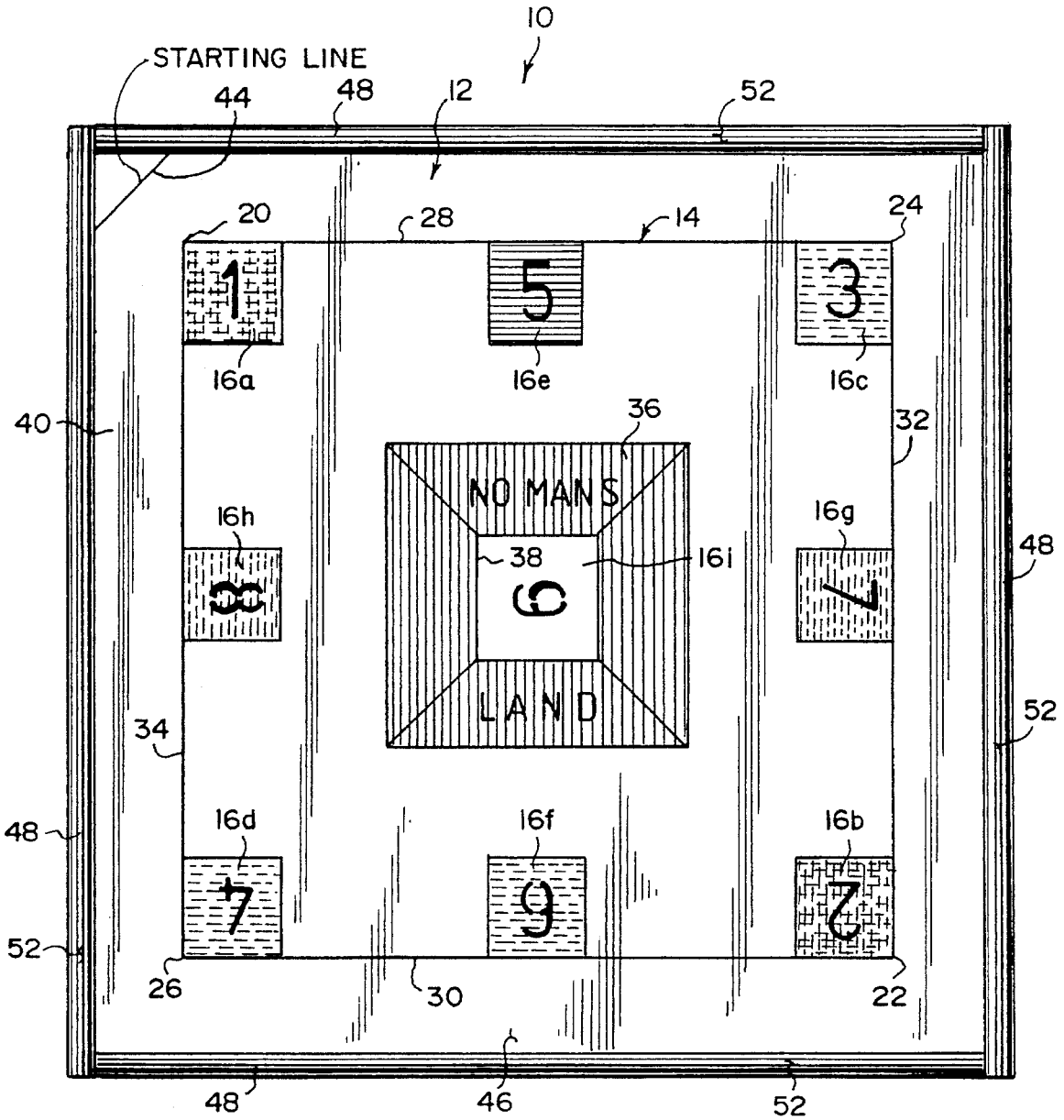
FIG. 4 is a top plan view of the game board completely assembled in a flat extended position.
Figure 5:
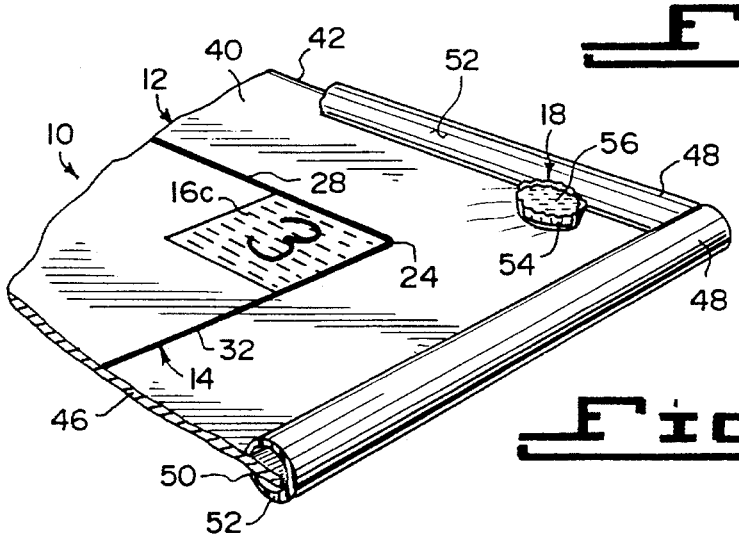
FIG. 5 is a perspective view of a corner portion of the game board with a puck hitting one of the bumper tubes.

Four bumper tubes 48 are also provided and are removably attached to each edge 42 of the flexible sheet 46. The bumper tubes 48 keep the flexible sheet 46 in an extended flat position when the game is played, as shown in FIG. 4 and to also prevent the pucks 18 from totally leaving the game board 12, as shown in FIG. 5. Each bumper tube 48 has a longitudinal slot 50 extending therethrough, so that the respective edge 42 of the sheet 46 can be inserted within the longitudinal slot 50. Each bumper tube 48 is fabricated out of a durable strong plastic material 52. Each puck 18 is made from a bottle cap 54 and a weighted material 56, such as wax, placed within the bottle cap 54. The bottle cap 54 is utilized in an upside-down position on the game board 12.

In the improved Skelly game 10, the bases 16*a* to 16*i* and the no man's land area 36 can be color coded with different colors for quick identification by the players.

It will be understood that each of the elements described above, or two or more together, may also find a useful application in other types of constructions differing from the type described above.

While the invention has been illustrated and described as embodied in an improved skelly game, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An apparatus for playing an improved skelly game comprising;

a) a square shaped game board having a court with a plurality of numbered bases randomly placed thereon, one of said bases being located at the center of said board and surrounded by an area designated no-man's land, said court being smaller in size than the total size of said game boards, thereby defining an out of bounds area between the perimeter of said court and the four edges of said game board;

b) a plurality of pucks, with each said puck used by each player, whereby said first player to propel said respective puck through each of said numbered bases in sequential order and then propel said puck through each of said numbered bases in a reverse sequential order wins the game, each of said pucks being a bottle cap containing a wax material for weighting and being utilized in an upside-down position on said game board;

a diagonal starting line located in said out of bounds area near one corner of said court adjacent a base, so that all of said pucks are put at said starting line at the beginning of the game to be propelled therefrom; and a bumper tube for each edge of said board, each tube being provided with a longitudinal slot so that an edge of said board can be inserted into said tube forming a substantially vertical wall with said board at the line of contact for maintaining said board in a flat position when being used and for preventing said pucks from leaving said board when the game is being played.

* * * * *